US007038636B2

(12) United States Patent
Larouche et al.

(10) Patent No.: US 7,038,636 B2
(45) Date of Patent: May 2, 2006

(54) HELICAL ANTENNA

(75) Inventors: Steve Larouche, St-Lazare (CA); Gerard Senechal, Ste-Anne-de-Bellevue (CA); François Bussieres, Notre-Dame-de-l'Ile-Perrot (CA); Sylvain Richard, Kirkland (CA); Andre Bouvrette, Ile Perrot (CA); John McDougall, St-Laurent (CA); Geoffrey Moss, Senneville (CA)

(73) Assignee: EMS Technologies Cawada, Ltd., Ste-Anne-de-Bellevue (QC) (CA)

( * ) Notice: Subject to any disclaimer, the term of this patent is extended or adjusted under 35 U.S.C. 154(b) by 0 days.

(21) Appl. No.: 10/868,210

(22) Filed: Jun. 16, 2004

(65) Prior Publication Data

US 2004/0257298 A1 Dec. 23, 2004

Related U.S. Application Data

(60) Provisional application No. 60/479,228, filed on Jun. 18, 2003.

(51) Int. Cl.
*H01Q 1/36* (2006.01)

(52) U.S. Cl. ..... 343/895; 343/878

(58) Field of Classification Search ..... 348/878, 348/895

See application file for complete search history.

(56) References Cited

U.S. PATENT DOCUMENTS

| | | | | | |
|---|---|---|---|---|---|
| 2,958,081 | A | * | 10/1960 | Dyson | 343/895 |
| 3,573,840 | A | | 4/1971 | Gouillou et al. | |
| 3,633,210 | A | * | 1/1972 | Westerman et al. | 343/895 |
| 3,681,772 | A | * | 8/1972 | Ingerson | 343/895 |
| 4,945,363 | A | | 7/1990 | Hoffman | |
| 5,134,422 | A | | 7/1992 | Auriol | |
| 5,255,005 | A | | 10/1993 | Terret et al. | |
| 5,329,287 | A | | 7/1994 | Strickland | |
| 5,479,180 | A | * | 12/1995 | Lenzing et al. | 343/729 |
| 5,479,182 | A | | 12/1995 | Sydor | |
| 5,541,617 | A | * | 7/1996 | Connolly et al. | 343/895 |
| 5,838,285 | A | * | 11/1998 | Tay et al. | 343/895 |
| 5,986,616 | A | * | 11/1999 | Edvardsson | 343/853 |
| 5,990,848 | A | | 11/1999 | Annamaa et al. | |
| 6,002,377 | A | | 12/1999 | Huynh et al. | |
| 6,088,000 | A | * | 7/2000 | Ho | 343/770 |
| 6,181,297 | B1 | * | 1/2001 | Leisten | 343/895 |
| 6,229,499 | B1 | | 5/2001 | Licul et al. | |
| 6,339,409 | B1 | | 1/2002 | Warnagiris | |
| 6,384,799 | B1 | | 5/2002 | Otomo et al. | |
| 6,429,830 | B1 | | 8/2002 | Noro et al. | |
| 6,433,755 | B1 | * | 8/2002 | Kuramoto | 343/895 |
| 6,496,159 | B1 | | 12/2002 | Noro | |
| 6,535,179 | B1 | | 3/2003 | Petros | |
| 6,778,149 | B1 | * | 8/2004 | Fukae et al. | 343/895 |
| 2003/0020670 | A1 | | 1/2003 | Noro | |

* cited by examiner

*Primary Examiner*—Tan Ho
(74) *Attorney, Agent, or Firm*—Protections Equinox Int'l; Frank Bonsang, Patent Agent

(57) ABSTRACT

A helical antenna has a helix supported by a helix support. The helix support includes at least one piece of flexible sheet having its two surfaces covered with a layer antistatic material. The flexible sheet is curlable into a revolution surface configuration to form a revolution surface-shaped support section for at least partially supporting a portion of the helix component there around. A grounding mechanism electrically grounds the external sheet surface to the helix and the two sheet surfaces to one another when in the revolution surface configuration while a locking mechanism locks the flexible sheet in the revolution surface configuration. The combination of the helix and the flexible support renders the antenna structurally relatively rigid in all directions.

34 Claims, 6 Drawing Sheets

HELICAL ANTENNA

CROSS-REFERENCE TO RELATED APPLICATION

Priority of U.S. Provisional Application No. 60/479,228, filed on Jun. 18, 2003, is hereby claimed.

FIELD OF THE INVENTION

The present invention relates to the field of antennas and is more particularly concerned with a helical antenna and the manufacturing thereof.

BACKGROUND OF THE INVENTION

It is well known in the art to use antennas mounted on a structure to allow communication with equipment located at a distance away. More specifically in the aerospace industry, global coverage antennas, shaped beam antennas and omni-directional antennas are conventionally mounted on spacecraft structure to allow specific communications to and from the ground through a ground station on Earth. These types of antenna typically include at least one helix component wound around an elongated Radio-Frequency (RF) transparent support.

Few examples of helical antennas are illustrated in the following publications:

- U.S. Pat. No. 3,573,840, issued Apr. 6, 1971, to Gouillou et al. for "Small Bulk Helically Wound Antennae and Method for Making Same";
- U.S. Pat. No. 4,945,363, issued Jul. 31, 1990, to Hoffman for "Conical Spiral Antenna";
- U.S. Pat. No. 5,134,422, issued Jul. 28, 1992, to Auriol for "Helical Type Antenna and Manufacturing Method Thereof";
- U.S. Pat. No. 5,255,005, issued Oct. 19, 1993, to Terret et al. for "Dual Layer Resonant Quadrifilar Helix Antenna";
- U.S. Pat. No. 5,329,287, issued Jul. 12, 1994, to Strickland for "End Loaded Helix Antenna";
- U.S. Pat. No. 5,479,182, issued Dec. 26, 1995, to Sydor for "Short Conical Antenna";
- U.S. Pat. No. 5,990,848, issued Nov. 23, 1999, to Arinamaa et al. for "Combined Structure of a Helical Antenna and a Dielectric Plate";
- U.S. Pat. No. 6,002,377 issued Dec. 14, 1999, to Huynh et al. for "Quadrifilar Helix Antenna";
- U.S. Pat. No. 6,229,499 issued May 8, 2001, to Licul et al. for "Folded Helix Antenna Design";
- U.S. Pat. No. 6,339,409 issued Jan. 15, 2002, to Warnagiris for "Wide Bandwidth Multi-Mode Antenna";
- U.S. Pat. No. 6,384,799 issued May 7, 2002, to Otomo et al. for "Antenna Having a Helical Antenna Element Extending Along a Cylindrical Flexible Substrate";
- U.S. Pat. No. 6,429,830 issued Aug. 6, 2002, to Noro et al. for "Helical Antenna, Antenna Unit, Composite Antenna";
- U.S. Pat. No. 6,496,159 issued Dec. 17, 2002, to Noro for "Simple Helical Antenna and Method of Producing the Same";
- U.S. Pat. No. 6,535,179 issued Mar. 18, 2003, to Petros for "Drooping Helix Antenna"; and
- U.S. patent application Ser. No. US 2003/0020670 A1 published Jan. 30, 2003, to Noro for "Helical Antenna".

The above-mentioned designs, however, could not be used in aerospace applications in which the complex and stringent mechanical and electrical environments the antennas encounter or need to survive impose multiple antenna design constraints of different natures such as electrical, mechanical, thermal, structural, manufacturing, electrostatic discharge (ESD), etc.

Accordingly, for example, the helix support of a typical spacecraft antenna needs to be as much as possible RF transparent but should also permit any static electrical charge built-ups to bleed off therefrom without damaging the antenna or even without affecting the RF signal of the antenna. Similarly, some materials and manufacturing processes are susceptible to generate Passive Inter-Modulation (PIM) products as well as multipaction which could be highly damageable to the antenna in space applications.

Conventional designs of helical antennas are suitable for small quantities, but when large amount of helical antennas are required as radiating elements in assemblies of array-type antennas, the manufacturing cost of a single helical antenna needs to be reduced.

Accordingly, there is a need for an improved helical antenna with a simple configuration.

SUMMARY OF THE INVENTION

It is therefore a general object of the present invention to provide an improved helical antenna.

An advantage of the present invention is that the helical antenna can withstand the well-known and severe launch and space environments.

Another advantage of the present invention is that the helical antenna is of substantially light weight. The use of relatively thin sheets for the helix support reduces the dielectric losses of the antenna and increases its power handling, especially in vacuum environment.

A further advantage of the present invention is that the helical antenna is designed to minimize generation of commonly known adverse Passive Inter-Modulation (PIM) products, within the material and at all critical component interfaces, as well as to minimize risk of multipaction effects.

Still another advantage of the present invention is that the helical antenna includes a helix support component that prevents electrical charge built-ups for Electro-Static Discharge (ESD) protection, at least on the external surface thereof.

Another advantage of the present invention is that the helical antenna is simple to assemble, manufacture and test, and is relatively inexpensive.

Still a further advantage of the present invention is that the helical antenna is made out of helix and support components locally relatively weak or flexible as individual parts, but when assembled together in the fashion described hereinbelow, results in a strong and stiff assembly.

According to an aspect of the present invention, there is provided a helical antenna, comprising: a helix component defining a helix axis, said helix component being made out of rigid-type electrically conductive material formed into a helix shape, said helix component being substantially flexible in an axial direction and in a bending direction generally transverse to the helix axis and substantially rigid in a radial compression direction; a helix support including a flexible sheet, said flexible sheet being curlable in a revolution surface configuration to form a revolution surface-shaped support section for at least partially supporting a portion of the helix component therearound, said section defining a section axis, said section axis being substantially in a co-linear relationship relative to the helix axis when said flexible sheet is in said revolution surface configuration; said support section being substantially rigid in said axial and bending directions and substantially flexible in said radial compression direction, said helix component and said support section structurally cooperating with one another so that said antenna is substantially rigid in axial, bending and radial compression directions when said support section supports said helix compound therearound.

In another aspect of the present invention, there is provided a helix support for supporting a groundable helix component of a helical antenna, the antenna defining a mounting base thereof, said helix support comprises: a flexible sheet being curlable in a revolution surface configuration to form a revolution surface-shaped support section for at least partially supporting a portion of the helix component therearound, said section defining a section axis; said flexible sheet defining generally opposed first and second sheet surfaces thereof, said first sheet surface being oriented outwardly when in said revolution surface configuration and including an antistatic coating thereon; a grounding means for electrically grounding said first sheet surface to said helix component when at least partially supporting said portion of said helix component thereon; a locking means for locking said flexible sheet in said revolution surface configuration.

In one embodiment, the flexible sheet defines generally opposed first and second interlocking edges interlockable to one another when in said revolution surface configuration, said locking means interlocking said first and second interlocking edges to one another.

Typically, the locking means includes a locking tab extending outwardly from said first interlocking edge and a tab receiving slot extending through said flexible sheet between said first and second sheet surfaces and substantially parallel to and adjacent said second interlocking edge for at least partially receiving said locking tab therein so as to secure said flexible sheet in said revolution surface configuration.

In one embodiment, the first and second sheet surfaces include an antistatic coating thereon, said grounding means further electrically grounding said first and second sheet surfaces to one another when in said revolution surface configuration.

Typically, the flexible sheet defines generally opposed first and second interlocking edges interlockable to one another when in said revolution surface configuration, said grounding means including a ground tab, said first and second sheet surfaces being at least partially in an overlap relationship relative to one another at a position adjacent said first and second interlocking edges respectively when said flexible sheet is in said revolution surface configuration, said ground tab extending outwardly from said first interlocking edge so as to have said antistatic coating on said first sheet surface of said first ground tab electrically connecting to said antistatic coating on said second sheet surface when said flexible sheet is in said revolution surface configuration.

In one embodiment, the flexible sheet defines generally opposed first and second end portions thereof, said first and second end portions being in an overlap relationship relative to one another when in said revolution surface configuration, said first sheet surface of said first end portion being in contact engagement with said second sheet surface of said second end portion when in said revolution surface configuration so as to form said grounding means between said first and second sheet surfaces.

Alternatively, the flexible sheet defines generally opposed first and second end portions thereof, said first and second end portions being in an overlap relationship relative to one another when in said revolution surface configuration, said first end portion having a plurality of through holes extending from said first sheet surface to said second sheet surface; said locking means including an adhesive, said adhesive substantially filling said plurality of through holes so as to secure said first and second end portions to one another when in said revolution surface configuration.

Typically, the plurality of through holes are substantially uniformly distributed relative to each other so as to cover said first end portion.

In one embodiment, the helix portion is substantially circumferentially and helically located around said support section, said helix portion defining a predetermined tangent point therealong, said helix portion extending substantially tangentially away from said support section at said predetermined tangent point, said support section having a through opening located adjacent said predetermined tangent point.

According to another aspect of the present invention, there is provided a helical antenna, comprising: a groundable helix component; a helix support for at least partially supporting said helix component, said helix support includes: a flexible sheet being curlable in a revolution surface configuration to form a revolution surface-shaped support section for at least partially supporting a portion of said helix component therearound, said section defining a section axis; said flexible sheet defining generally opposed first and second sheet surfaces thereof, said first sheet surface being oriented outwardly when in said revolution surface configuration and including an antistatic coating thereon; a grounding means for electrically grounding said first sheet surface to said helix component when at least partially supporting said portion of said helix component thereon; a locking means for locking said flexible sheet in said revolution surface configuration.

In one embodiment, the helix component defines a helix axis, said helix component being substantially flexible in an axial direction and in a bending direction generally transverse to said helix axis and substantially rigid in a radial direction; said section axis being substantially in a co-linear relationship relative to said helix axis when said flexible sheet is in said revolution surface configuration; said support section being substantially rigid in said axial and bending directions and substantially flexible in said radial direction, said helix component and said support section structurally cooperating with one another so that said antenna is substantially rigid in said axial, bending and radial directions when said support section supports said helix component therearound.

In a further aspect of the present invention, there is provided a helix support for supporting a helix component of a helical antenna, the antenna defining a mounting base thereof, said helix support comprises: first flexible sheet being curlable in a first revolution surface configuration to form a first revolution surface-shaped support section for at least partially supporting a first portion of the helix component therearound, said first section defining a first section axis; second flexible sheet being curlable in a second revolution surface configuration to form a second revolution surface-shaped support section for at least partially supporting a second portion of the helix component therearound, said second section defining a second section axis, said second section being connectable to said first section with said second section axis extending substantially along said first section axis.

In one embodiment, the first and second revolution surface configurations are substantially cylindrical and conical configurations to form cylindrical-shaped and conical-shaped support sections, respectively.

Typically, the first flexible sheet defines generally opposed first and second sheet surfaces thereof, said first and second sheet surfaces including an antistatic coating thereon, said helix support further including a grounding means for electrically grounding said first and second sheet surfaces to one another.

Typically, the first flexible sheet defines generally opposed first and second interlocking edges interlockable to one another, said first and second sheet surfaces being at least partially in a overlap relationship relative to one another at a position adjacent said first and second interlocking edges respectively, said first flexible sheet including a first ground tab, said first ground tab extending outwardly from said first interlocking edge so as to have said first sheet surface of said first ground tab electrically connecting to said second sheet surface, thereby forming said grounding means.

Typically, the second flexible sheet defines generally opposed third and fourth sheet surfaces thereof, said third and fourth sheet surfaces including an antistatic coating thereon.

Typically, the second flexible sheet defines generally opposed third and fourth interlocking edges interlockable to one another, said third and fourth sheet surfaces being at least partially in a overlap relationship relative to one another at a position adjacent said third and fourth interlocking edges respectively, said second flexible sheet including a second ground tab, said second ground tab extending outwardly from said third interlocking edge so as to have said third sheet surface of said second ground tab electrically connecting to said fourth sheet surface.

Typically, the second flexible sheet defines a first interconnecting edge extending between said third and fourth interlocking edges, said second flexible sheet including a third ground tab, said third ground tab extending outwardly from said first interconnecting edge so as to have said third sheet surface of said third ground tab electrically connecting to said second sheet surface when said second section is connected to said first section.

Typically, the helix support further includes a connecting means for connecting said first and second flexible sheets to one another.

Typically, the connecting means includes a connecting tab and a tab receiving slot for at least partially receiving said connecting tab therein so as to connect said first and second sections in a end-to-end relationship relative to one another with said second section axis extending substantially along said first section axis.

Typically, the first flexible sheet defines a second interconnecting edge extending between said first and second interlocking edges, said second interconnecting edge being interlockable to said first interconnecting edge; said connecting tab extending outwardly from one of said first and second interconnecting edges, said tab receiving slot extending through corresponding said first and second flexible sheets of the other one of said first and second interconnecting edges and substantially parallel to and adjacent the other one of said first and second interconnecting edges.

In one embodiment, the mounting base is electrically conductive, said grounding means further electrically grounding said first flexible sheet to said mounting base.

Typically, the grounding means includes a generally elongated and flexible ground strap, said ground strap defining generally opposed main strap surfaces and generally opposed strap longitudinal ends, at least one of said strap main surfaces being an antistatic surface, said strap longitudinal ends of said antistatic surface being electrically connectable to said first sheet surface and said mounting base, respectively, so as to electrically ground said helix support to said mounting base.

In one embodiment, the first flexible sheet defines generally opposed first and second sheet surfaces thereof, and said second flexible sheet defines generally opposed third and fourth sheet surfaces thereof, said first and third sheet surfaces facing generally radially outwardly from said first and second sections respectively and being coverable with an antistatic coating thereon to allow electrostatic charge built-up to bleed off therefrom.

Other objects and advantages of the present invention will become apparent from a careful reading of the detailed description provided herein, with appropriate reference to the accompanying drawings.

BRIEF DESCRIPTION OF THE FIGURES

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
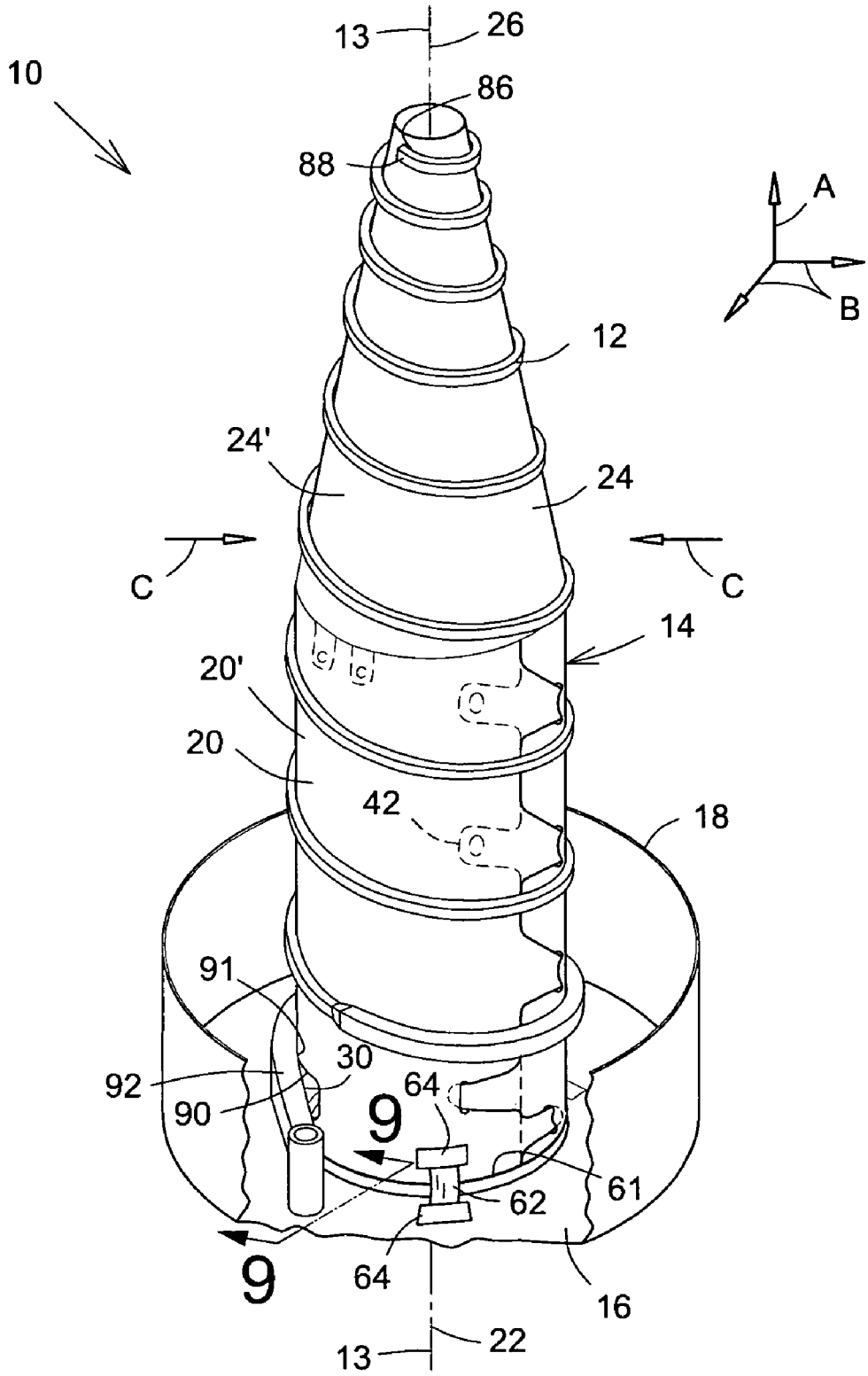
FIG. 1 is a partially broken top perspective view of an embodiment of a helical antenna in accordance with the present invention.

Referring to FIG. 1, there is schematically shown an embodiment of a helix antenna 10 in accordance with the present invention. The antenna 10 typically includes an electrical conductor or component 12 having a substantially helix shape and defining a helix axis 13, a helix support 14 and a mounting base 16 generally supporting the support 14 and the helix 12, and typically having a conventional cup shape 18. Although the present embodiment 10 is illustrated with one helical conductor 12, a plurality of conductors 12 could be used and mounted on the same support 14 without departing from the scope of the present invention.

Referring more specifically to FIGS. 1 to 4, the helix support 14 is mounted on the mounting base 16 of the antenna 10. The helix support 14 includes a first or lower flexible sheet 20 or blank that is curlable, from a first substantially rectangular planar or flat development configuration (see FIG. 4) into a second substantially cylindrical configuration, to form a cylindrical-shaped support first section 20' for at least partially supporting a first or lower portion of the helix component 12 there around. The first section 20' defines a first section axis 22. A second or upper flexible sheet 24 or blank is curlable, from a first substantially truncated triangular planar or flat development configuration (see FIG. 3) into a second substantially conical configuration, to form a substantially truncoconical-shaped support second section 24' for at least partially supporting a second or upper portion of the helix component 12 there around. The second section 24' defines a second section axis 26 and is connectable to the first section 20' with the second section axis 26 extending substantially along the first section axis 22, in a substantially co-linear relationship there between. The first and second sections 20', 24' support the helix 12 with their axes 13, 22, 26 substantially co-linear with each other.

The first and second sheets 20, 24 are typically made out of a flexible and partially Radio-Frequency (RF) transparent thermoplastic material, such as, but not limited to, commonly known polyester or polyethylene terephthalate (PET) (including Mylar™), polyimide (including Kapton™), fluorinated ethylene propylene (FEP) (including polytetrafluoroethylene (PTFE) Teflon™) and the like materials.

The first flexible sheet 20 defines generally opposed first or external and second or internal sheet surfaces 28, 30 thereof, respectively. The first flexible sheet 20 generally includes a typically thin layer (in the range of approximately two thousand angstroms (2000 Å), 0.2 μm or less, depending on the coating itself) of an antistatic or semi-conductive coating 32 such as, but not limited to, commonly known indium-tin oxide (ITO), germanium, and the like material typically deposited at least on the first sheet surface 28 of the sheet material typically under vacuum condition, although other application processes could be selected such as antistatic paint, spray, dipping and the like. A typical antistatic coating 32 provides a surface resistivity typically varying between about ten to the power six to about ten to the power nine ohms per square ($10^6$ to $10^9$ Ω/□), considering the RF signal frequency transmitted by the antenna 10. Preferably, both first and second sheet surfaces 28, 30 are coated with the antistatic coating 32.

Similarly, the second flexible sheet 24 defines generally opposed third or external and fourth or internal sheet surfaces 34, 36 thereof, respectively. The second flexible sheet 24 also generally includes an antistatic coating 32 the third and fourth sheet surfaces including an antistatic coating deposited on the third and fourth sheet surfaces 34, 36 of the corresponding sheet material.

The first flexible sheet 20 further defines generally opposed first and second interlocking edges 38, 40 that are interlockable to one another in the cylindrical configuration. A grounding means typically provides for an electrical grounding between the first and second sheet surfaces 28, 30. Typically, the first and second sheet surfaces 28, 30 are at least partially in an overlap relationship relative to one another at a position adjacent the first and second interlocking edges 38, 40 respectively, for electrically grounding the two sheet surfaces 28, 30 to one another when the first flexible sheet 20 is in its cylindrical configuration.

Figure 2:
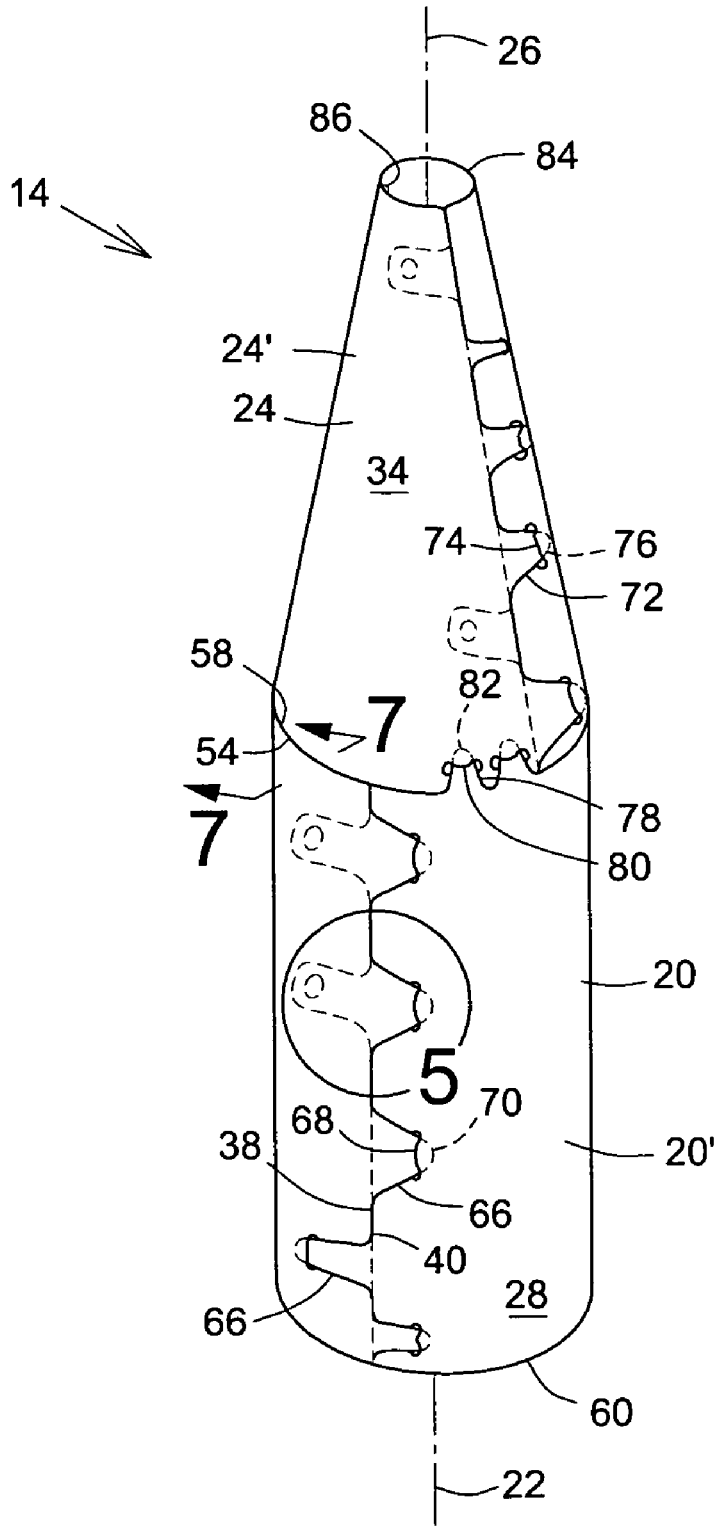
FIG. 2 is a top perspective view of the cylindrical and conical sections of the helix support of the embodiment of FIG. 1 in the assembled configuration.
Figure 3:
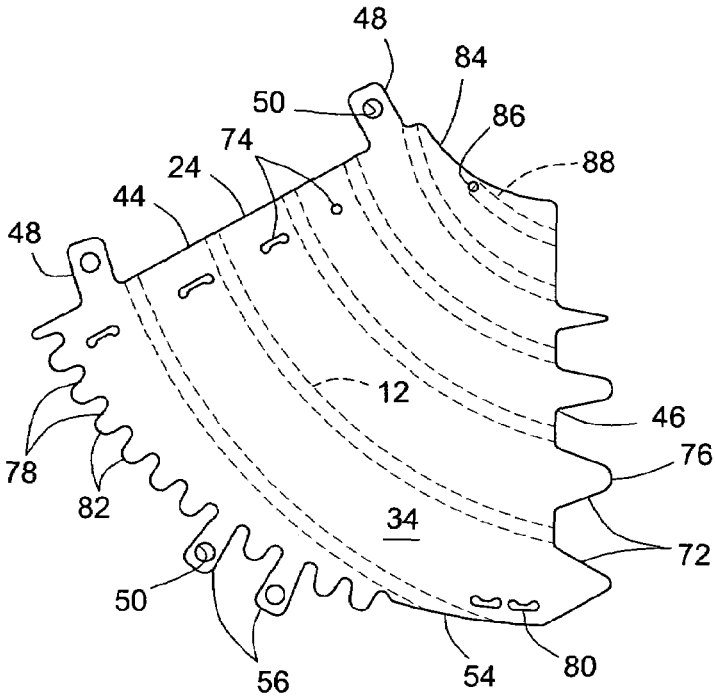
FIG. 3 is a top plan view of the blank of the upper conical section of the helix support of the embodiment of FIG. 1 in its flat development configuration.
Figure 4:
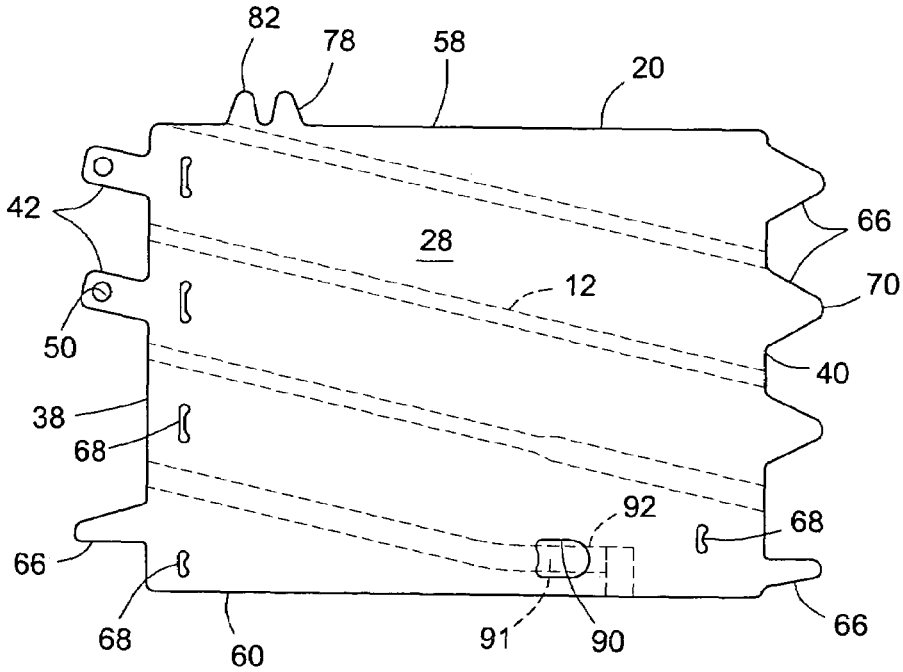
FIG. 4 is a top plan view of the blank of the lower cylindrical section of the helix support of the embodiment of FIG. 1 in its flat development configuration.
Figure 5:
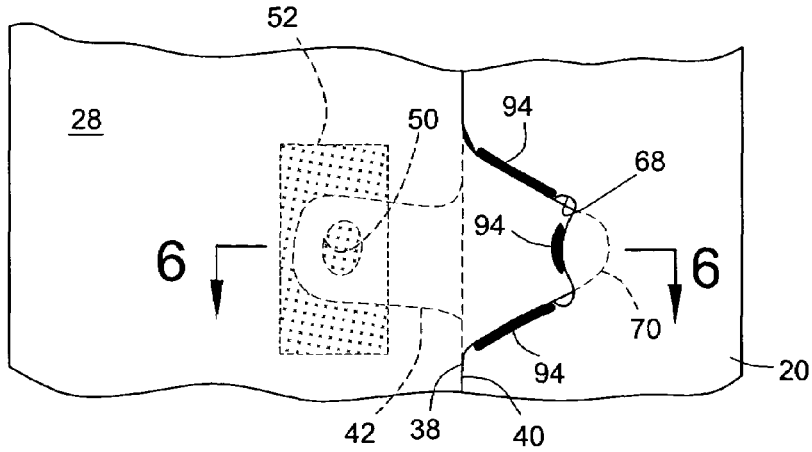
FIG. 5 is a partially broken enlarged view taken along line 5 of FIG. 2, showing a locking tab interlocked with the corresponding tab receiving slot for securing the lower sheet into its cylindrical configuration.
Figure 6:
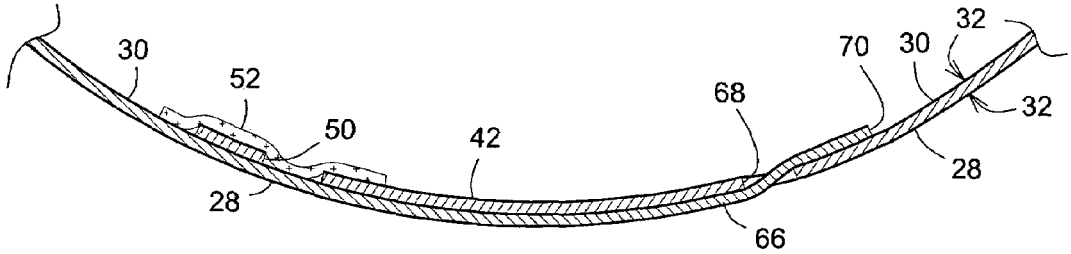
FIG. 6 is a partially broken enlarged section view taken along line 6—6 of FIG. 5, showing a ground tab attachment for electrically grounding the two surfaces of the cylindrical section of the helix support to one another.

Accordingly, as a typical grounding means, the first flexible sheet 20 includes, at least one, first ground tabs 42 extending substantially outwardly from the first interlocking edge 38 such that the portion of the external sheet surface 28 on the ground tabs 42 is in overlap contact engagement with the internal sheet surface 30 when the first flexible sheet 20 is in its cylindrical configuration, as illustrated in FIGS. 2, 5 and 6.

Similarly, the second flexible sheet 24 further defines generally opposed third and fourth interlocking edges 44, 46 that are interlockable to one another in the conical configuration. The third and fourth sheet surfaces 34, 36 are at least partially in an overlap relationship relative to one another at a position adjacent the third and fourth interlocking edges 44, 46 respectively, for electrically grounding the two sheet surfaces 34, 36 to one another when the second flexible sheet 24 is in its conical configuration.

Accordingly, the second flexible sheet 24 includes, at least one, second ground tabs 48 extending substantially outwardly from the third interlocking edge 44 such that the portion of the external sheet surface 34 on the ground tabs 48 is in overlap contact engagement with the internal sheet surface 36 when the second flexible sheet 24 is in its conical configuration, as illustrated in FIG. 2.

In order to properly ensure the electrical contact by maintaining the abutment contact engagement between the corresponding sheet surfaces 28 and 30, or 34 and 36, each ground tab 42, 48, includes an opening 50, typically circular, extending there through to allow a typical piece of adhesive tape 52 or the like overlapping the ground tab 42, 48 to have increased available contact surface area with the corresponding underlying sheet surface 28, 30, 34, 36 underneath, as shown in FIGS. 3 to 6.

In order to electrically ground the first and second sections 20', 24' to one another, the second flexible sheet 24 defines a first or lower interconnecting edge 54 that extends between the third and fourth interlocking edges 44, 46. The second flexible sheet 24 includes, at least one, third ground tabs 56 extending outwardly from the first interconnecting edge 54 so as to have the third sheet surface 34 of the third ground tabs 56 electrically connecting to the second sheet surface 30 at a position adjacent a second or upper interconnecting edge 58, being interlockable to the first interconnecting edge 54, that extends between the first and second interlocking edges 38, 40 when the second section 24' is connected to the first section 20'.

Figure 9:
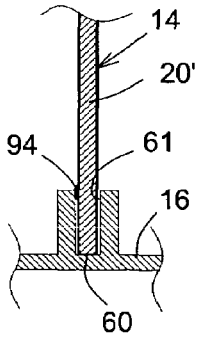
FIG. 9 is a partially broken enlarged section view taken along line 9—9 of FIG. 1, showing the connection between the cylindrical section and the mounting base.

As shown in FIGS. 1 and 2, the first flexible sheet 20 defines a third or lower interconnecting edge 60 extending between the first and second interlocking edges 38, 40 and being generally opposite to the second interconnecting edge 58. The first section 20' of the helix support 14 is connectable to the mounting base 16 of the antenna 10 with the third interconnecting edge 60 engaging a substantially circular groove 61 thereof, as shown in FIG. 9. Typically, the external sheet surface 28 of the support 14 is electrically grounded to the generally electrically conductive mounting base 16 using a grounding means such as at least one substantially elongated ground strap 62 made out of a material similar than the helix support 14 and coated on at least one side or surface thereof with an antistatic coating 32. The ground strap 62 has its two longitudinal ends of a coated side in contact by abutting engagement with the helix support 14 and the adjacent mounting base 16 respectively under the pressure of pieces of an adhesive tape 64 or the like.

A locking means is used to lock the first and second flexible sheets 20, 24 in their respective cylindrical and conical configurations, as well as to provide some physical reference guides of the required shape and/or size of their configurations. Typically, the locking means allows for interlocking the first and second interlocking edges 38, 40 to one another and at least partially securing the first flexible sheet 20 in its cylindrical configuration.

The locking means includes, at least one, locking tabs 66 that extend outwardly from one of the first and second interlocking edges 38, 40 and tab receiving slots 68 that extend through the first flexible sheet 20 between the first and second sheet surfaces 28, 30 and substantially parallel to and adjacent the other one of the first and second interlocking edges 38, 40 for at least partially receiving a tip portion 70 (in FIG. 6 and in dotted lines in FIGS. 2 and 5) of a corresponding locking tab 66.

Similarly, the locking means also allows for interlocking the third and fourth interlocking edges 44, 46 to one another and at least partially securing the second flexible sheet 24 in its conical configuration.

The locking means includes, at least one, locking tabs 72 that extend outwardly from one of the third and fourth interlocking edges 44, 46 and tab receiving slots 74 that extend through the second flexible sheet 24 between the third and fourth sheet surfaces 34, 36 and substantially parallel to and adjacent the other one of the third and fourth interlocking edges 44, 46 for at least partially receiving a tip portion 76 (shown in dotted lines in FIG. 2) of a corresponding locking tab 72.

A connecting means is used to connect the first and second flexible sheets 20, 24 to one another in their respective cylindrical and conical configurations in a end-to-end relationship relative to one another with the second section axis 26 extending substantially along the first section axis 22, as well as to provide some physical reference guides their connection.

Figure 7:
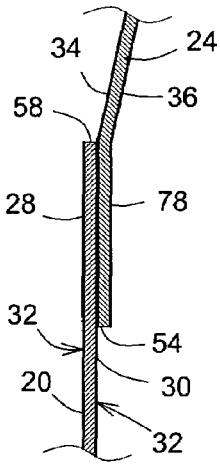
FIG. 7 is a partially broken enlarged section view taken along line 7—7 of FIG. 2, showing a connecting tab of the conical section resiliently connected in abutting contact engagement against with the corresponding surface of the cylindrical section.

Typically, the connecting means includes, at least one, connecting tabs 78 that extend outwardly from one of the first and second interconnecting edges 54, 58 for connection with the other one of the first and second interconnecting edges 54, 58 by resilient abutting engagement there against, using the resiliency or flexibility of the material itself, as shown in FIG. 7. Alternatively, the connecting means includes tab receiving slots 80 that extend through the corresponding of the first and flexible sheets 20, 24 of the other one of the first and second interconnecting edges 54, 58 and substantially parallel to and adjacent the other one of the first and second interconnecting edges 54, 58 for at least partially receiving a tip portion 82 (shown in dotted lines in FIG. 2) of a corresponding connecting tab 78.

As shown in FIGS. 1 and 2, the first section 20' is positioned intermediate the second section 24' and the mounting base 16. Accordingly, the second flexible sheet 24 defines a free upper edge 84 that extends between the third and fourth interlocking edges 44, 46 and is generally opposite to the first interconnecting edge 54. A small circular hole 86 is typically located on the second flexible sheet 24 adjacent the free upper edge 84 to essentially locate the position of the upper tip end 88 of the helical conductor 12.

The first flexible sheet 20 typically includes a window 90 or through opening located generally adjacent a tangent point 91 of the lower end 92 of the helical conductor 12 therewith to avoid possible multipaction effects in space applications, with the tangent point 91 facing the window 90.

The helical conductor 12, being obviously an electrical conductor itself, is typically grounded via the RF signal connection at its lower end 92 adjacent the antenna base 16.

Figure 8:
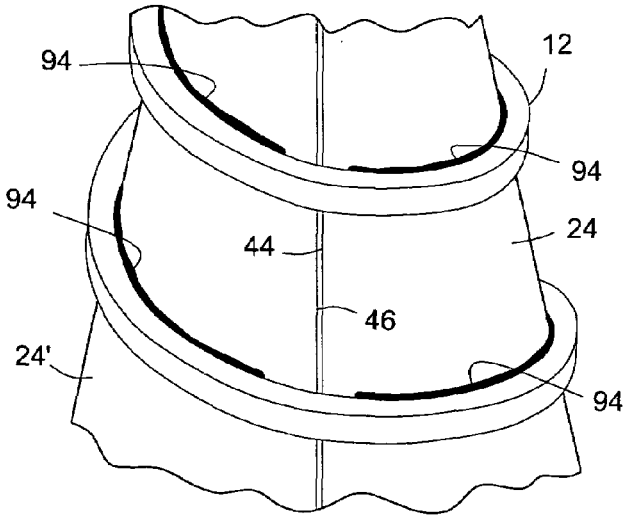
FIG. 8 is a partially broken enlarged view of the conical section of the embodiment of FIG. 1, showing an attachment of the helical conductor to the helix support.

In order to ensure a proper contact attachment between the helical conductor 12 and its support 14, a bead of adhesive 94, preferably non-conductive, or any other suitable glue, bonding or fastening agent, either continuous or in multiple segments, is typically located at the intersection there between in addition to the existing compressive contact, as schematically illustrated in FIG. 8. Similar beads of adhesive 94 are typically located at the different locking tabs 66, 72 and connecting tabs 78 to secure them in place and along the circular groove 61 to secure the helix support 14 therein, as schematically represented in FIGS. 5 and 9, respectively. Typically, the adhesive 94 is non-conductive, especially when Passive Inter-Modulation (PIM) products are of a concern. Otherwise, a conductive adhesive 94 could be considered which would also improve the electrical grounding between the different surfaces.

The compressive contact also typically ensures an electrical grounding between the first and third external sheet surfaces 28, 34 and the helix conductor 12 whenever required.

Referring back to FIG. 1, the innovative helical antenna 10 is generally made out of the helix conductor or component 12 and the support component 14, when taken independently in the assembled configuration, are relatively weak or flexible in a respective direction and relatively rigid or stiff in the other. However, when taken together as a whole and structurally interacting or cooperating with each other, they provide an antenna that is relatively rigid in all directions.

Accordingly, the helix conductor 12 is generally a rigid-type electrically conductive material that is typically obtained from machining, forming (plastically shaped), casting or the like manufacturing process.

More specifically, the helix component 12, taken alone, is generally relatively flexible or weak in the axial direction A and in a bending direction B generally transverse to the axial direction A (as a conventional coil spring) when one longitudinal end is secured to a mounting base 16 while it is generally relatively stiff or rigid in the radial direction C (against compressive loads). In the opposite, the helix support 14, or first and second flexible sheets 20, 24 in their formed configuration 20', 24', taken alone, is generally relatively rigid in both the axial and bending directions A, B (especially when secured to the circular groove 61) while it is generally relatively flexible in the radial direction C. When assembled together to form the antenna 10, they essentially structurally cooperate with each other such that the respective directional stiffness provide an antenna 10 that is generally relatively rigid in all the axial, bending and radial directions A, B, C.

As shown in FIGS. 1 to 4, the different locking tabs 66, 72 and connecting tabs 78 with their corresponding slots 68, 74, 80 are typically located in-between adjacent windings or spirals of the helix 12 to ensure that the surface underneath the helix 12 is as uniform as possible with no sheet overlap, in order to minimize RF signal losses and multipaction risks. For clarity purpose, the path or pattern of the helix 12 on the first and second flexible sheets 20, 24 is schematically represented in dotted lines in FIGS. 4 and 3 respectively.

As shown throughout the Figures, the different slots 68, 74, 80 and other openings 50, 86, 88, as well as the different internal and external corners of the first and second flexible sheets 20, 24 are all rounded to avoid conventionally local tears and/or cracks (not shown) that could eventually damage the antenna 10.

Alternatives

Referring to FIGS. 10 to 14, there is schematically shown another embodiment 110 of a helix antenna in accordance with the present invention. The antenna 110 typically includes an electrical conductor or component 112 made out of a tubular metallic material plastically pre-shaped to the proper helix dimensions, a helix support 114 and a mounting base 16. The helix component 112 is generally supported by the helix support 114, preferably locally using the adhesive 94, at least partially along the helix 112.

The second embodiment 110 mainly differs from the first one 10 by its first flexible sheet 120 that includes different locking means and grounding means, more suitable for larger size antennae.

Figure 12:
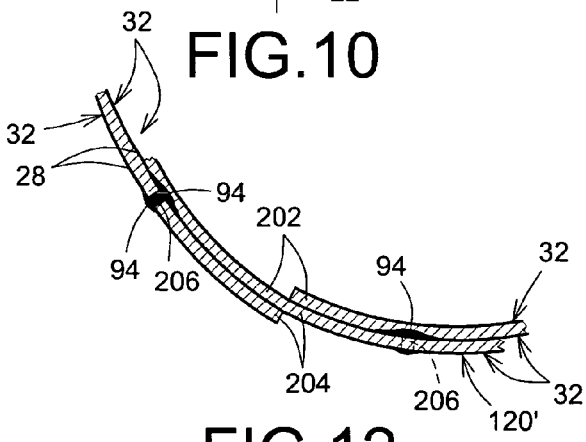
FIG. 12 is a partially broken enlarged section view taken along line 12—12 of FIG. 11, showing the bonding and grounding connections of the two surfaces of the cylindrical section of the embodiment of FIG. 10.
Figure 11:
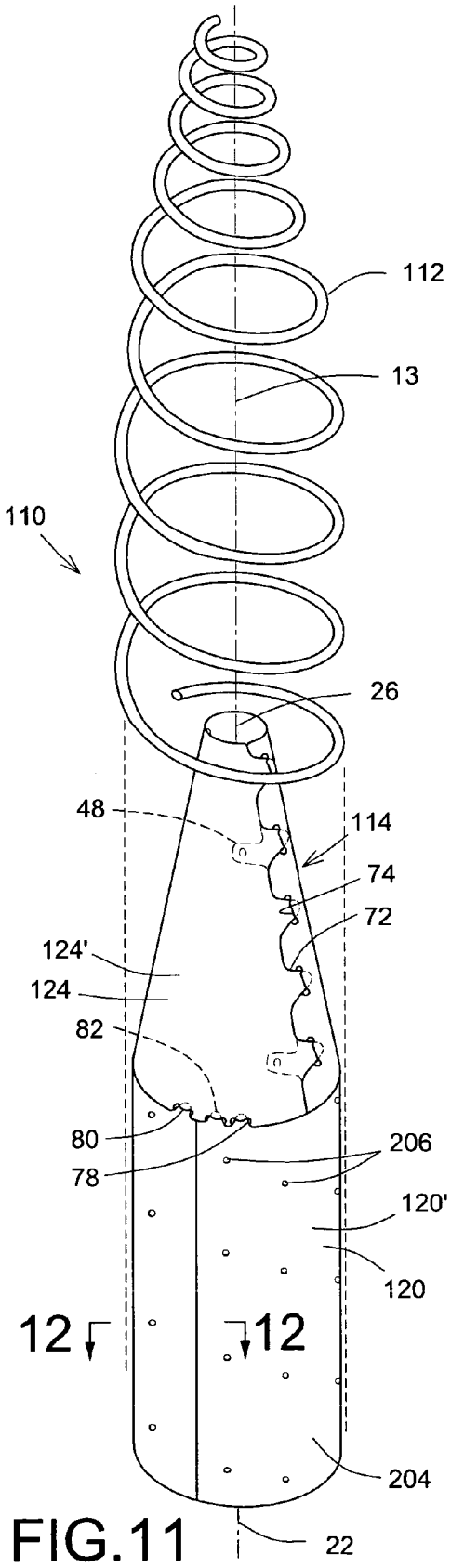
FIG. 11 is an exploded top perspective view of the helix with the cylindrical and conical sections of the helix support of the embodiment of FIG. 10 during assembly.
Figure 13:
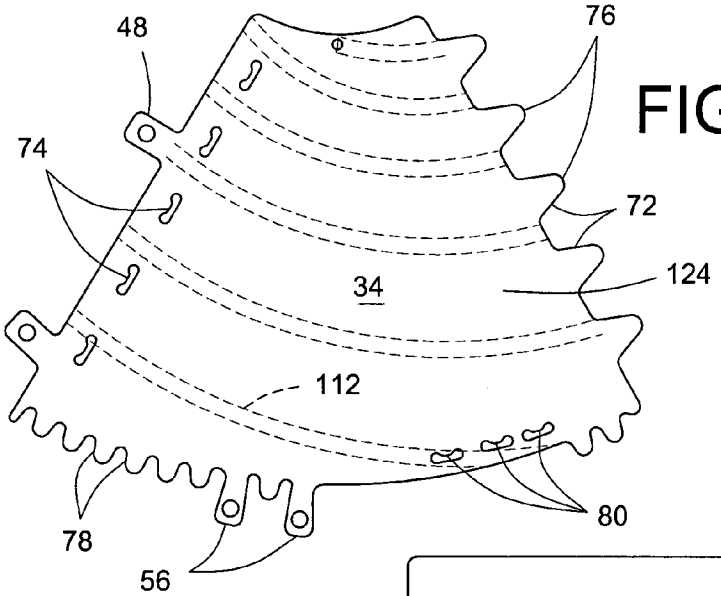
FIG. 13 is a top plan view of the blank of the upper conical section of the helix support of the embodiment of FIG. 10 in its flat development configuration.
Figure 14:
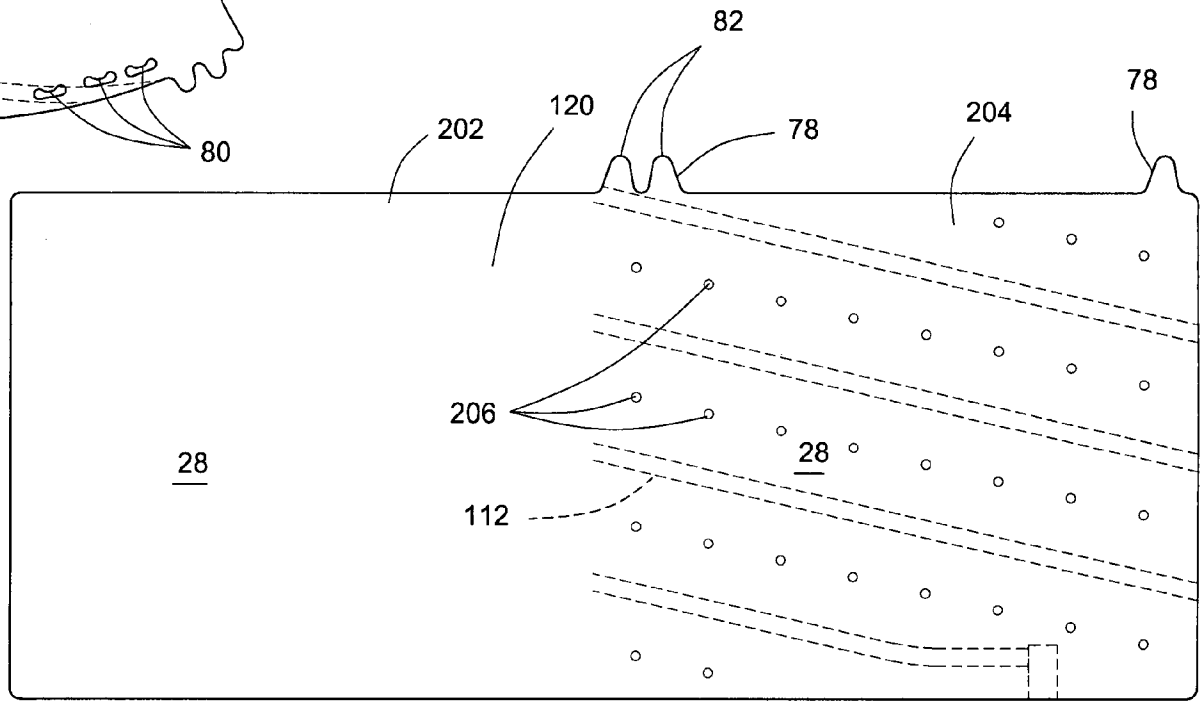
FIG. 14 is a top plan view of the blank of the lower cylindrical section of the helix support of the embodiment of FIG. 10 in its flat development configuration.

More specifically, the flexible sheet 120 defines generally opposed first 202 and second 204 end portions thereof, as shown in FIG. 14. The first and second end portions 202, 204 are adapted to be in an overlap relationship relative to one another when the flexible sheet 120 is in its revolution surface configuration to form the support first section 120', as illustrated in FIG. 12. In that overlap configuration, the first sheet surface 28 of the first end portion 202 is in contact engagement with the second sheet surface 30 of the second end portion 204 of the first section 120' to form the grounding means between the two sheet surfaces 28, 30 coated with an antistatic or semi-conductive coating 32.

The second end portion 204 typically has a plurality of through holes 206 extending from the first sheet surface 28 to the second sheet surface 30. The locking means typically includes an adhesive 94 that substantially fills the plurality of through holes 206 to secure the first and second end portions 202, 204 to one another to maintain the first sheet 120 in its revolution surface configuration. As schematically shown in FIG. 12, the adhesive 94 will have a tendency to partially fill in any gap between the two end portions 202, 204 by capillarity phenomena, to improve the adhesion there between. Obviously, the adhesive 94 could be used to improve the electrical grounding if a conductive adhesive 94 is considered.

Figure 10:
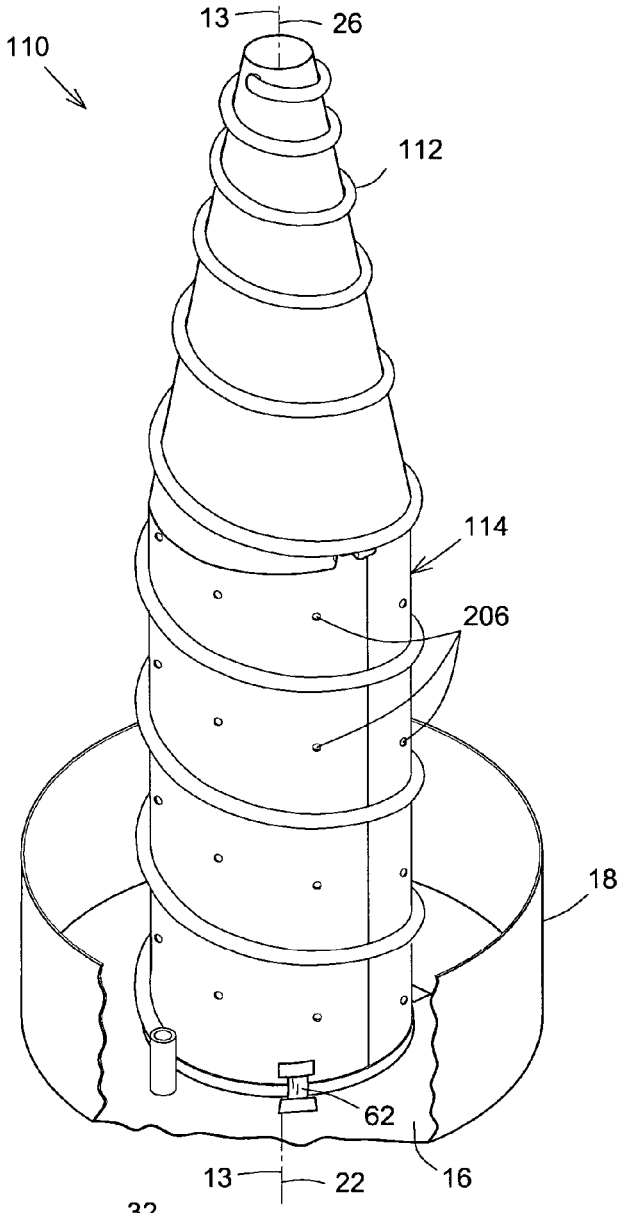
FIG. 10 is a view similar to FIG. 1, showing another embodiment of a helical antenna in accordance with the present invention.

Although not essential, the through holes 206 are substantially uniformly distributed relative to each other to cover the second end portion 204 to uniformly secure the first section 120' in its revolution surface configuration. Preferably, the through holes 206 form spirals located typically half-way in-between spirals of the conductor 112, to avoid any possible mechanical interference therewith, as seen in FIG. 10.

In the embodiment 110 shown in FIG. 10 to 14, a different quantity of connecting tabs 78 are used to connect the second flexible sheet 124 forming the second section 124' of the antenna support 114 to the first section 120'. Also, it is to be noted that the second embodiment 110 does not include any multipaction window 90 at the lower end of the first sheet 120.

Although the locking tabs 66, 72, whenever present, are shown as being generally located on a same interlocking edge 40, 46, it would be obvious to one skilled in the art that they could be alternately or differently located on both interlocking edges 38, 40 or 44, 46 of one of the first and second flexible sheets 20, 24, 124 without departing from the scope of the present invention, as evidenced by the lowermost locking tab 66 and corresponding slot 68 of the first flexible sheet 20.

Obviously, any other type of locking means such as adhesive tape or the like could be considered without departing from the scope of the present invention.

As it would be obvious to one having skill in the art, any other type and/or shape of grounding means, including conductive beads of material, could be used to ground the different coated surfaces to one another and perform the same function as the different ground tabs 42, 48, 56 without departing from the scope of the present invention. Typically, all grounding paths between different antenna components are made redundant for increased reliability of the antenna 10, 110.

Similarly, the above described helix supports 14, 114 are obviously not restricted for use with a helical conductor 12, 112 of the rigid-type as shown in FIGS. 1, 8, 10 and 11 but could support other types of conductor made out of electrically conductive tapes or foils, etched patterns and the like, depending on the actual size and/or requirements of the antenna 10, 110.

Also, a single piece support or multi-piece support 14, 114 could be considered depending on the physical characteristics of the helical antenna 10, 110 and more specifically of the helical conductor 12, 112 without departing from the scope of the present invention. Similarly, the flexible support 14, 114 could have the shape of any revolution surface, including but not limited to cylindrical, trunco- conical and hemispherical surfaces, when in the formed configuration without departing from the scope of the present invention.

Although the present embodiments have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A helical antenna, comprising:

a helix component defining a helix axis, said helix component being made out of rigid-type electrically conductive material formed into a helix shape, said helix component being substantially flexible in an axial direction and in a bending direction generally transverse to the helix axis and substantially rigid in a radial compression direction;

a helix support including a flexible sheet, said flexible sheet being curlable in a revolution surface configuration to form a revolution surface-shaped support section for at least partially supporting a portion of the helix component therearound, said section defining a section axis, said section axis being substantially in a co-linear relationship relative to the helix axis when said flexible sheet is in said revolution surface configuration;

said support section being substantially rigid in said axial and bending directions and substantially flexible in said radial compression direction, said helix component and said support section structurally cooperating with one another so that said antenna is substantially rigid in said axial, bending and radial compression directions when said support section supports said helix component therearound.

2. The antenna of claim 1, wherein said flexible sheet is at least partially Radio-Frequency transparent, said antenna further including an antistatic coating covering said helix component and said support section to allow electrostatic charge built-up to bleed off therefrom, said antistatic coating being at least partially Radio-Frequency transparent.

3. The antenna of claim 2, wherein said antistatic coating is an antistatic paint.

4. A helix support for supporting a groundable helix component of a helical antenna, the antenna defining a mounting base thereof, said helix support comprising:

a flexible sheet being curlable in a revolution surface configuration to form a revolution surface-shaped support section for at least partially supporting a portion of the helix component therearound, said section defining a section axis;

said flexible sheet defining generally opposed first and second sheet surfaces thereof, said first sheet surface being oriented outwardly when in said revolution surface configuration and including an antistatic coating thereon;

a grounding means for electrically grounding said first sheet surface to said helix component when at least partially supporting said portion of said helix component thereon;

a locking means for locking said flexible sheet in said revolution surface configuration.

5. The helix support of claim 4, wherein said flexible sheet defines generally opposed first and second interlocking edges interlockable to one another when in said revolution surface configuration, said locking means interlocking said first and second interlocking edges to one another.

6. The helix support of claim 5, wherein said locking means includes a locking tab extending outwardly from said first interlocking edge and a tab receiving slot extending through said flexible sheet between said first and second sheet surfaces and substantially parallel to and adjacent said second interlocking edge for at least partially receiving said locking tab therein so as to secure said flexible sheet in said revolution surface configuration.

7. The helix support of claim 4, wherein said first and second sheet surfaces include an antistatic coating thereon, said grounding means further electrically grounding said first and second sheet surfaces to one another when in said revolution surface configuration.

8. The helix support of claim 7, wherein said flexible sheet defines generally opposed first and second interlocking edges interlockable to one another when in said revolution surface configuration, said grounding means including a ground tab, said first and second sheet surfaces being at least partially in an overlap relationship relative to one another at a position adjacent said first and second interlocking edges respectively when said flexible sheet is in said revolution surface configuration, said ground tab extending outwardly from said first interlocking edge so as to have said antistatic coating on said first sheet surface of said first ground tab electrically connecting to said antistatic coating on said second sheet surface when said flexible sheet is in said revolution surface configuration.

9. The helix support of claim 7, wherein said flexible sheet defines generally opposed first and second end portions thereof, said first and second end portions being in an overlap relationship relative to one another when in said revolution surface configuration, said first sheet surface of said first end portion being in contact engagement with said second sheet surface of said second end portion when in said revolution surface configuration so as to form said grounding means between said first and second sheet surfaces.

10. The helix support of claim 4, wherein said flexible sheet defines generally opposed first and second end portions thereof, said first and second end portions being in an overlap relationship relative to one another when in said revolution surface configuration, said first end portion having a plurality of through holes extending from said first sheet surface to said second sheet surface;

said locking means including an adhesive, said adhesive substantially filling said plurality of through holes so as to secure said first and second end portions to one another when in said revolution surface configuration.

11. The helix support of claim 10, wherein said plurality of through holes are substantially uniformly distributed relative to each other so as to cover said first end portion.

12. The helix support of claim 4, wherein said flexible sheet and said antistatic coating are at least partially Radio-Frequency transparent.

13. The helix support of claim 4, wherein said helix portion is substantially circumferentially and helically located around said support section, said helix portion defining a predetermined tangent point therealong, said helix portion extending substantially tangentially away from said support section at said predetermined tangent point, said support section having a through opening located adjacent said predetermined tangent point.

14. A helical antenna, comprising:

a groundable helix component;

a helix support for at least partially supporting said helix component, said helix support including:

a flexible sheet being curlable in a revolution surface configuration to form a revolution surface-shaped support section for at least partially supporting a portion of said helix component therearound, said section defining a section axis;

said flexible sheet defining generally opposed first and second sheet surfaces thereof, said first sheet surface being oriented outwardly when in said revolution surface configuration and including an antistatic coating thereon;

a grounding means for electrically grounding said first sheet surface to said helix component when at least partially supporting said portion of said helix component thereon;

a locking means for locking said flexible sheet in said revolution surface configuration.

15. The antenna of claim 14, wherein:

said helix component defines a helix axis, said helix component being substantially flexible in an axial direction and in a bending direction generally transverse to said helix axis and substantially rigid in a radial direction;

said section axis being substantially in a co-linear relationship relative to said helix axis when said flexible sheet is in said revolution surface configuration;

said support section being substantially rigid in said axial and bending directions and substantially flexible in said radial direction, said helix component and said support section structurally cooperating with one another so that said antenna is substantially rigid in said axial, bending and radial directions when said support section supports said helix component therearound.

16. The antenna of claim 15, wherein said helix component is made out of a rigid-type electrically conductive material.

17. The antenna of claim 14, wherein said helix portion is substantially circumferentially and helically located around said support section, said helix portion defining a predetermined tangent point therealong, said helix portion extending substantially tangentially away from said support section at said predetermined tangent point, said support section having a through opening located adjacent said predetermined tangent point.

18. The antenna of claim 14, wherein said helix support with said antistatic coating are at least partially Radio-Frequency transparent.

19. A helix support for supporting a helix component of a helical antenna, the antenna defining a mounting base thereof, said helix support comprising:

first flexible sheet being curlable in a first revolution surface configuration to form a first revolution surface-shaped support section for at least partially supporting a first portion of the helix component therearound, said first section defining a first section axis;

second flexible sheet being curlable in a second revolution surface configuration to form a second revolution surface-shaped support section for at least partially supporting a second portion of the helix component therearound, said second section defining a second section axis, said second section being connectable to said first section with said second section axis extending substantially along said first section axis.

20. The helix support of claim 19, wherein said first and second revolution surface configurations are substantially cylindrical and conical configurations to form cylindrical-shaped and conical-shaped support sections, respectively.

21. The helix support of claim 20, wherein said first flexible sheet defines generally opposed first and second sheet surfaces thereof, said first and second sheet surfaces including an antistatic coating thereon, said helix support further including a grounding means for electrically grounding said first and second sheet surfaces to one another.

22. The helix support of claim 21, wherein said first flexible sheet defines generally opposed first and second interlocking edges interlockable to one another, said first and second sheet surfaces being at least partially in a overlap relationship relative to one another at a position adjacent said first and second interlocking edges respectively, said first flexible sheet including a first ground tab, said first ground tab extending outwardly from said first interlocking edge so as to have said first sheet surface of said first ground tab electrically connecting to said second sheet surface, thereby forming said grounding means.

23. The helix support of claim 22, wherein said second flexible sheet defines generally opposed third and fourth sheet surfaces thereof, said third and fourth sheet surfaces including an antistatic coating thereon.

24. The helix support of claim 23, wherein said second flexible sheet defines generally opposed third and fourth interlocking edges interlockable to one another, said third and fourth sheet surfaces being at least partially in a overlap relationship relative to one another at a position adjacent said third and fourth interlocking edges respectively, said second flexible sheet including a second ground tab, said second ground tab extending outwardly from said third interlocking edge so as to have said third sheet surface of said second ground tab electrically connecting to said fourth sheet surface.

25. The helix support of claim 24, wherein said second flexible sheet defines a first interconnecting edge extending between said third and fourth interlocking edges, said second flexible sheet including a third ground tab, said third ground tab extending outwardly from said first interconnecting edge so as to have said third sheet surface of said third ground tab electrically connecting to said second sheet surface when said second section is connected to said first section.

26. The helix support of claim 25, further including a connecting means for connecting said first and second flexible sheets to one another.

27. The helix support of claim 26, wherein said connecting means includes a connecting tab and a tab receiving slot for at least partially receiving said connecting tab therein so as to connect said first and second sections in a end-to-end relationship relative to one another with said second section axis extending substantially along said first section axis.

28. The helix support of claim 27, wherein said first flexible sheet defines a second interconnecting edge extending between said first and second interlocking edges, said second interconnecting edge being interlockable to said first interconnecting edge; said connecting tab extending outwardly from one of said first and second interconnecting edges, said tab receiving slot extending through corresponding said first and second flexible sheets of the other one of said first and second interconnecting edges and substantially parallel to and adjacent the other one of said first and second interconnecting edges.

29. The helix support of claim 21, wherein said first section is positioned intermediate said second section and the mounting base.

30. The helix support of claim 29, wherein said mounting base is electrically conductive, said grounding means further electrically grounding said first flexible sheet to said mounting base.

31. The helix support of claim 30, wherein said grounding means includes a generally elongated and flexible ground strap, said ground strap defining generally opposed main strap surfaces and generally opposed strap longitudinal ends, at least one of said strap main surfaces being an antistatic surface, said strap longitudinal ends of said antistatic surface being electrically connectable to said first sheet surface and said mounting base, respectively, so as to electrically ground said helix support to said mounting base.

32. The helix support of claim 20, wherein said first flexible sheet defines generally opposed first and second sheet surfaces thereof, and said second flexible sheet defines generally opposed third and fourth sheet surfaces thereof, said first and third sheet surfaces facing generally radially outwardly from said first and second sections respectively and being coverable with an antistatic coating thereon to allow electrostatic charge built-up to bleed off therefrom.

33. The helix support of claim 32, wherein said first and second flexible sheets and said antistatic coating are at least partially Radio-Frequency transparent.

34. The helix support of claim 19, wherein said first portion of the helix component is substantially circumferentially and helically located around said first section, said first portion defining a predetermined tangent point therealong, said first portion extending substantially tangentially away from said first section at said predetermined tangent point, said first section having a through opening located adjacent said predetermined tangent point.

* * * * *